United States Patent [19]

Kimble

[11] Patent Number: 5,072,856

[45] Date of Patent: Dec. 17, 1991

[54] TOY WEB-SHOOTING GLOVE

[76] Inventor: Stephen E. Kimble, 2607 N. Wilson Ave., Tucson, Ariz. 85719

[21] Appl. No.: 528,419

[22] Filed: May 25, 1990

[51] Int. Cl.[5] ..... B67D 5/64

[52] U.S. Cl. ..... 222/78; 222/175; 222/402.25; 2/160; 239/529; 446/475

[58] Field of Search ..... 2/159, 160, 161 R, 161 A, 2/16; 42/1.11, 54; 109/29, 32; 239/211, 289, 375, 529; 272/27 W, 27 N; 273/349; 446/26, 475, 473, 483; 222/192, 175, 78, 79, 74, 75, 635, 394, 402.23, 402.25, 405

[56] References Cited

U.S. PATENT DOCUMENTS

| | | | |
|---|---|---|---|
| 1,177,412 | 3/1916 | Hopkins | 239/529 |
| 1,534,208 | 4/1925 | Gibson | 239/529 X |
| 1,885,180 | 11/1932 | Cameron | 222/175 |
| 2,192,082 | 2/1940 | Hunicke | 222/175 |
| 3,445,046 | 5/1969 | Wilson | 224/26 |
| 3,523,645 | 8/1970 | Beauchamp | 239/154 |
| 3,945,571 | 3/1976 | Rash | 239/152 |
| 4,037,790 | 7/1977 | Reiser et al. | 239/529 |
| 4,214,674 | 7/1980 | Jones et al. | 222/79 |
| 4,286,407 | 9/1981 | Adickes, Jr. et al. | 222/215 X |
| 4,768,681 | 9/1988 | Dean et al. | 222/175 X |
| 4,848,246 | 7/1989 | Rosen | 109/25 |
| 4,890,767 | 1/1990 | Burlison | 222/78 |
| 4,903,864 | 2/1990 | Sirhan | 222/78 |
| 4,997,110 | 3/1991 | Swenson | 222/175 |

*Primary Examiner*—Kevin P. Shaver
*Assistant Examiner*—Kenneth DeRosa
*Attorney, Agent, or Firm*—Antonio R. Durando; Harry M. Weiss

[57] ABSTRACT

The combination of known components to produce a new toy shooting apparatus. A toy that makes it possible for a player to act like a spider person by shooting webs from the palm of his or her hand. The webbing material consists of string foam delivered from a hidden pressurized container through a valve incorporated into a glove worn by the player. A trigger mechanism enables the player to activate the valve at will by the exercise of pressure with the fingers of the hand wearing the glove.

20 Claims, 1 Drawing Sheet

TOY WEB-SHOOTING GLOVE

BACKGROUND OF THE INVENTION

1. Field of the Invention

This invention pertains to the general field of toy shooting apparatuses. In particular, it provides a new device for expelling string foam from the palm of a glove to create a spider-like web for amusement purposes.

2. Description of the Prior Art

All kinds of shooting toys have been designed and built over time for the amusement of children and adults alike. Water is normally the medium used as projectile and water guns are the most common type of toy utilized for this purpose. They come in the shape of hand guns, rifles, machine guns, and other configurations allowing the player to squirt water from various parts, often hidden, of his or her body.

Other shooting devices simply consist of a can container that is hand held, pointed in the desired direction by the user, and triggered by some sort of mechanism incorporated within the can itself. These devices often deliver projectiles meant to be more impressive than water, such as washable paints, foams or colorful mists. Recently, aerosol string foam cans have enjoyed particular success among children as party novelty substitutes for streamers and similar items.

Some of the technology applied to these kinds of devices is obviously available also for other uses that require the directional spraying of liquids or gases. Thus, some of the same concepts are found in paint spray guns, in apparatuses for delivering insecticides and herbicides, in aerosol weapons, and in other similar devices that involve a portable and self-contained system of storage and delivery.

For example, U.S. Pat. No. 3,445,046 to Wilson (1969) describes a holster for aerosol containers with a valve actuator that allows a person wearing it to eject fluid in a predetermined direction without handling the container itself. Designed for use on a belt, the invention is directed particularly to the fast and accurate spraying of tear gas by policemen without having to draw the device from the holster.

In U.S. Pat. No. 3,523,645 (1970), Beauchamp discloses a complicated apparatus to repel mosquitoes and similar insects without having to handle the dispensing container. This invention is directed to people who wish to be able to protect themselves from insects when the need arises without interrupting their normal activities, such as fishermen and farmers.

Rash, in U.S. Pat. No. 3,945,571 (1976), shows a new kind of portable spray-gun apparatus. The objective is the ability to carry the source of pressure around while applying the paint, instead of having to rely on a long air hose from a compressor, which is often cumbersome and limiting. The invention is directed solely to the use of spray guns for painting purposes.

In U.S. Pat. No. 4,037,790 (1977), Reiser et al. describe a toy water glove featuring a valve in the palm section of the glove that allows the wearer to spray water while shaking hands. A bulb containing the liquid is kept directly in the palm and it releases water in a forward direction from the wrist when squeezed. No umbilical cord from a water tank is necessary.

U.S. Pat. No. 4,214,674 to Jones et al. (1980) illustrates a self-contained toy water gun. Capable of squirting either intermittently or continuously, this device consists of a pressurized tank and a line to a toy handgun to be worn and carried around by the user. When the tank is empty, it can be refilled and re-pressurized by a pumping mechanism. The attraction of this invention lies in the relatively large amount of water made available and in the continuous delivery option.

In U.S. Pat. No. 4,890,767 (1990), Burlison describes a headband water squirter connected to a hand-held reservoir and trigger mechanism. Basically a water gun, this invention squirts from the wearer's forehead instead of his or her hand. It is intended to provide children with a more exotic amusement weapon than the usual handgun-shaped toy.

Finally, in U.S. Pat. No. 4,903,864 (1990), Sirhan discloses a glove amusement device for squirting water from the tip of a finger. Connected to a water reservoir by a length of flexible tubing, the glove contains a mechanical trigger to activate a pump for squirting through the opening on the fingertip. The pump is driven by an electrical power source incorporated in the reservoir.

The present invention involves a device for shooting string foam in the air according to a novel idea to create the impression that a spider web is being formed. The device combines a variety of components found in prior art and incorporates novel features to achieve the specific objectives of the invention.

BRIEF SUMMARY OF THE INVENTION

One objective of this invention is the development of a novel device for shooting string foam from the palm of a hand to give the impression that a spider web is being formed by the actor. This is achieved by an apparatus that comprises a glove with a hidden delivery nozzle in the palm with a trigger mechanism that is activated by the tip of a finger curled over it.

Another objective of the invention is a system that permits the user to carry a string foam reservoir inconspicuously under the playful pretense that the string foam, and therefore the spider web, is generated in the hand. Thus, an umbilical cord is provided to carry and deliver the pressurized string foam in aerosol form from a container holstered around the body of the wearer. Both cord and container can be easily concealed, if so desired.

A further goal of the invention is an apparatus constructed with separate components to avoid waste upon disposal. Therefore, the disposable pressurized string foam container and cord are separate and detachable from the re-usable glove and trigger components.

Yet another objective of this invention is that it be safe for children's use as a party novelty or similar items. For this purpose the device consists of known components of proven reliability and safety.

A final objective is the easy and economical manufacture of the web-shooting glove. This is achieved by using commercially available components and materials, modified to fit the requirements of this invention.

Various other purposes and advantages of the invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

The heart of this invention lies in the optimal combination of known mechanical principles in order to produce a new toy shooting apparatus. It is well known that shooting toys enjoy wide commercial acceptance. Similarly, items that stimulate children's playful imagination are in great demand, especially when they lead the player to identify with popular cartoon characters or heroes. Accordingly, this invention creates a toy that makes it possible for a player to act like a spider person by shooting webs from the palm of his or her hand. The webbing material consists of string foam delivered from a hidden pressurized container through a valve incorporated into a glove worn by the player.

Figure 1:
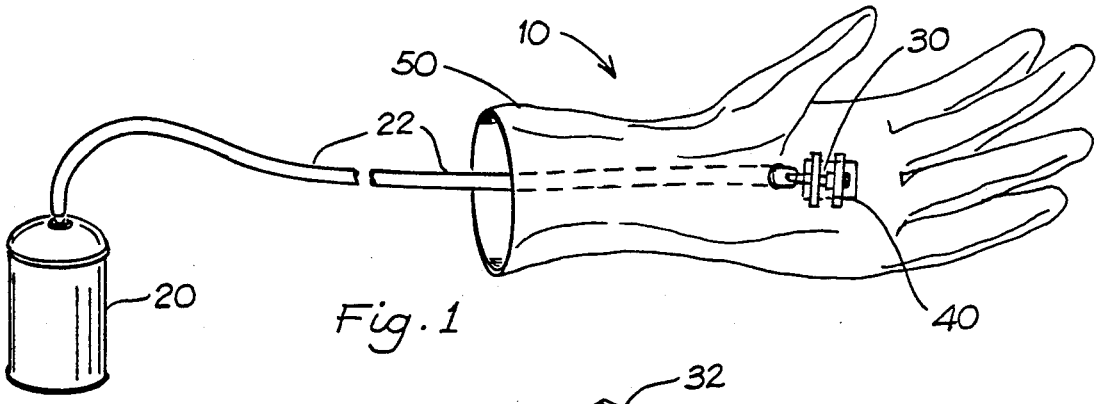
FIG. 1 is a perspective view of the web-shooting glove according to this invention, including a pressurized string foam canister, an umbilical cord, and a glove with a release trigger mechanism incorporated into its palm.

Referring to FIG. 1, a perspective view of the preferred embodiment of the invention 10 is illustrated. This web-shooting apparatus consists of two distinct parts. The first part constitutes a single unit and comprises a pressurized canister 20 containing the string foam in aerosol form, a flexible line 22 attached to the canister and forming an umbilical cord for the remote delivery of the string foam, and a valve 30 for its release attached to the end of such line (shown in detail in FIG. 2). The second part is a glove 50 that incorporates a valve housing 40 (shown in detail in FIG. 3) capable of holding the valve 30 for actuation by pressure exerted by the player's fingers, curled over it. This embodiment of the invention is so designed in order to permit the simple connection of the disposable canister, cord and valve ensemble with the reusable glove and trigger unit, and the practical disconnection thereof after use.

The canister 20 is of the type well known in the prior art for containing pressurized fluids in general and for string foam in particular. Instead of having a valve for spraying the foam from the top of the can, as done with commercially available string foam cans, canister 20 is connected directly to one end of the line 22, which is also pressurized by the canister's contents. This line is flexible and long enough to permit the umbilical connection of the canister with the release valve 30 hermetically connected to the other end of the line and attached to the palm of the glove 50. Line 22 must be capable of safely withstanding the of the foam suspension in canister 20 under normal conditions of use. If desired, a belt or harness for a holster to carry the canister can also be provided (not shown in the figures).

Figure 2:
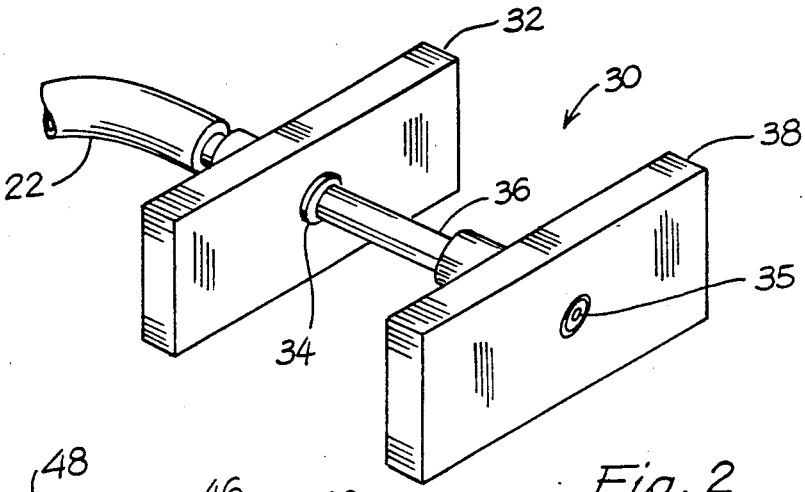
FIG. 2 is a perspective view of a release valve at the end of the umbilical cord.

The details of the valve 30 are illustrated in FIG. 2. Using the same principle of the valves typically found on spray cans, valve 30 consists of a seat 32 with an opening 34 capable of slideably and hermetically housing a spring-loaded hollow plunger 36, which is in turn incased into and through a trigger 38. The seat 32 is connected to the line 22 and contains means, well known in prior art (not shown in the figures), for releasing the pressurized foam when the trigger 38 (and therefore the plunger 36) is pressed inward and for interrupting the flow when the plunger is released. Thus, when the trigger 38 is pushed, it actuates the valve system by causing the plunger 36 to slide through the opening 34 and release the flow of foam from the line 22, first through the plunger itself and finally to the outside environment in spray form through the orifice 35.

Figure 3:
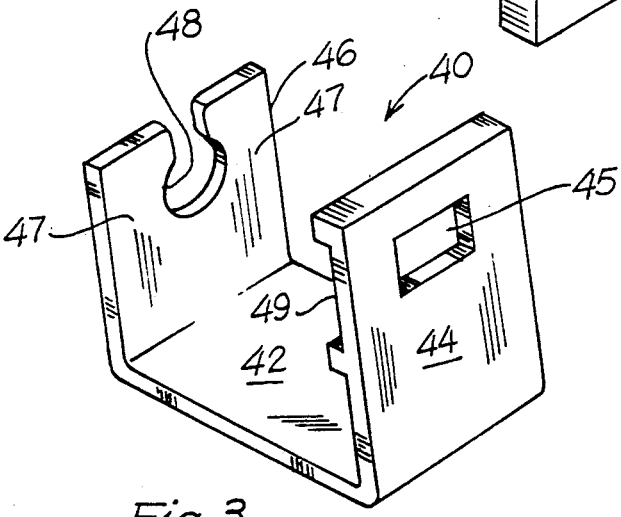
FIG. 3 is a perspective view of a valve housing attached to the palm portion of the glove to hold and actuate the valve shown in FIG. 2.

Referring to FIG. 3, the valve housing 40 is described in detail, It consists of resilient material formed with a flat base 42 and two side members, 44 and 46, protruding upward from it. This valve housing is attached to the glove 50 by inserting its side members from the inside of the palm portion of the glove through two appropriately sized apertures, so that they protrude out of the glove itself (see FIG. 1). The valve housing is kept in place during use by the pressure exerted on its base by the palm of the user's hand against the glove or by any other fastening means, such as stitches or glue. The side member 46, placed toward the wrist of the hand, protrudes backwards at an obtuse angle from the base 42 and it contains an opening 48 capable of receiving and holding the line 22 so that the base 32 of the valve is seated on the inside surface 47. The side member 44, placed toward the fingers of the hand, protrudes approximately parallelly to the side 46 from the base 42 and it contains a notched portion 49 for receiving and holding in place the trigger 38. This side member 44 also contains an opening 45 to permit the free flow of foam when the valve is activated.

Figure 4:
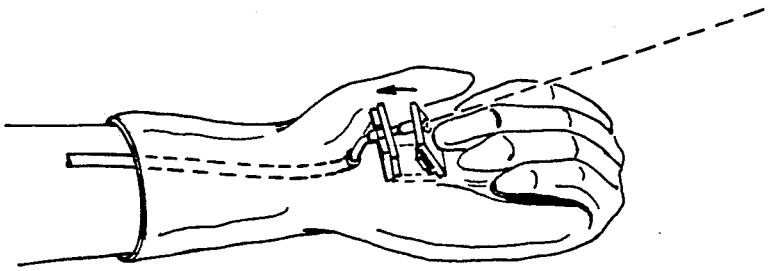
FIG. 4 is a view of the web-shooting glove according to this invention showing a user pushing on the valve's trigger and a stream of string foam being released into the air.

Thus, the valve 30 is connected to the valve housing 40 by inserting the base 32 and trigger 38 between the side members 46 and 44, and by snapping it in place by pushing the line 22 into the opening 48 and the trigger 38 into the notched portion 49. Although not necessary for practicing the invention, the line 22 leading to the valve 30 may be hidden inside a sheath along the wrist portion of the glove (as shown in FIGS. 1 and 4). By wearing the canister 20 on a belt or in an inside pocket and by running the line 22 along a long sleeve, the device can be disguised to look like a common glove. In an alternative embodiment, the canister could similarly be strapped to the wrist of a wearer, possibly hidden under a long sleeve, and be connected to the valve 30 by a short length of line 22. The trigger 30 and housing 40, located approximately at the center of the palm, are easily hidden by the fingers curled over them.

By pushing backwards on the trigger lever 44 with the fingers of the hand wearing the apparatus of this invention, the plunger 36 is caused to activate the valve and release the pressurized foam through the orifice 35 and the opening 45. The relative positions of the opening 48 and the notched portion 49 are chosen so as to insure a trajectory of spray that is generally forward, but sufficiently raised from the plane of the palm of the hand to insure clearing of the fingers while in a folded position. An illustration of the operation of the web-shooting glove is given in FIG. 4.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatuses and methods.

What I claim is:

1. A toy glove for shooting string foam, comprising:
(a) a pressurized assembly for storing, transporting and delivering a foam suspension, consisting of a canister attached to a delivery line with terminal valve means for releasing said suspension in the form of string foam;
(b) a glove; and
(c) a holder incorporated into the palm of said glove for housing and actuating said valve means by the action of the fingers of the hand wearing said glove;
said pressurized assembly and said glove constituting two separable units to permit the replacement of the pressurized assembly upon exhaustion of the foam suspension.

2. The toy glove described in claim 1, wherein said valve means holder consists of a resilient bracket capable of holding said valve means in place pointing generally in a forward direction and capable of actuating said valve means by transferring the action of the fingers of the hand wearing said glove to the trigger mechanism of said valve means.

3. The toy glove described in claim 1, wherein said valve means consists of a plunger-type valve actuated by a trigger affixed to the tip of the plunger, wherein the valve is activated at will and reversibly by pressing on said trigger thus causing the flow of string foam through the plunger and the trigger to the surrounding environment.

4. The toy glove described in claim 1, wherein said delivery line consists of flexible tubing permanently attached to the outlet of said canister at one end and to said terminal valve means at the other end, of sufficient length of provide hydraulic connection between said canister hidden inside a garment word by a user and said terminal valve means in the palm of the glove worn by said user, and capable of withstanding the maximum pressure generated by the foam suspension stored in the system.

5. The toy glove described in claim 1, wherein the wrist portion of said glove comprises a sheath for hiding the portion of said flexible tubing proximate to the connection with said terminal valve means.

6. The toy glove described in claim 1, further comprising:
(c) a body harness for carrying and holstering said canister.

7. The toy glove described in claim 1, wherein said canister is strapped to the wrist of the glove wearer and the length of said flexible tubing is limited to the distance between the wrist and the palm of an average user.

8. A method of shooting string foam to create the playful illusion of forming a web, comprising the following steps:
(a) providing a pressurized assembly for storing, transporting and delivering a foam suspension, consisting of a canister attached to a delivery line with terminal valve means for releasing said suspension in the form of string foam;
(b) providing a glove; and
(c) providing a holder incorporated into the palm of said glove for housing and actuating said valve means by the action of the fingers of the hand wearing said glove;
said pressurized assembly and said glove constituting two separable units to permit the replacement of the pressurized assembly upon exhaustion of the foam suspension.

9. The method described in claim 8, wherein said valve means holder consists of a resilient bracket capable of holding said valve means in place pointing generally in a forward direction and capable of actuating said valve means by transferring the action of the fingers of the hand wearing said glove to the trigger mechanism of said valve means.

10. The method described in claim 8, wherein said valve means consists of a plunger-type valve actuated by a trigger affixed to the tip of the plunger, wherein the valve is activated at will and reversibly by pressing on said trigger, thus causing the flow of string foam through the plunger and the trigger to the surrounding environment.

11. The method described in claim 8, wherein said delivery line consists of flexible tubing permanently attached to the outlet of said canister at one end and to said terminal valve means at the other end, of sufficient length to provide hydraulic connection between said canister hidden inside a garment worn by a user and said terminal valve means in the palm of the glove worn by said user, and capable of withstanding the maximum pressure generated by the foam suspension stored in the system.

12. The method described in claim 8, wherein the wrist portion of said glove comprises a sheath for hiding the portion of said flexible tubing proximate to the connection with said terminal valve means.

13. The method described in claim 8, further comprising:
(c) a body harness for carrying and holstering said canister.

14. The method described in claim 8, wherein said canister is strapped to the wrist of the glove wearer and the length of said flexible tubing is limited to the distance between the wrist and the palm of an average user.

15. A toy glove for shooting string foam, comprising:
(a) a pressurized assembly for storing, transporting and delivering a foam suspension, consisting of a canister attached to a delivery line with terminal valve means for releasing said suspension in the form of string foam;
(b) a glove; and
(c) a resilient housing for said valve means comprising a flat base and first and second side members protruding upward from it, wherein said hosing is attached to said glove by inserting said side members from the inside of the palm portion of said glove through two apertures so that they protrude out of the glove; said first side member being placed toward the wrist of the hand, protruding backwards at an obtuse angle from said base, and containing an opening capable of receiving and holding said delivery line so that said valve means is seated on the inside surface of said first side member; and said second side member being placed toward the fingers of the hand, protruding approximately parallelly to said first side member from said base, and containing a notched portion for receiving and holding in place said valve means and an opening for permitting the free flow of said foam suspension when said valve means is activated; and wherein the relative positions of said opening in said first side member and said notched portion in said second side member are chosen so as to insure a trajectory of spray that is generally forward and sufficiently raised from the plane of said palm portion of said glove to ensure clearing of the fingers of a user while in a folded position;

said pressurized assembly and said glove constituting two separable units to permit the replacement of the pressurized assembly upon exhaustion of the foam suspension.

16. The to glove described in claim 15, wherein said valve means comprises a seat with an opening capable of slideably and hermetically housing a spring-loaded hollow plunger, which is in turn incased into and through a trigger; said seat being connected to said delivery line and containing means for releasing said foam suspension when said trigger and said plunger are pressed inward and for interrupting the flow when said trigger and plunger are released; and said trigger being held in place by said notched portion in said second side member of said resilient housing.

17. The toy glove described in claim 16, wherein said delivery line consists of flexible tubing permanently attached to the outlet of said canister at one end and to said terminal valve means at the other end, of sufficient length to provide hydraulic connection between said canister hidden inside a garment worn by a user and said terminal valve means in the palm of the glove worn by said user, and capable of withstanding the maximum pressure generated by the foam suspension stored in the system.

18. The toy glove described in claim 17, wherein the wrist portion of said glove comprises a sheath for hiding the portion of said flexible tubing proximate to the connection with said terminal valve means.

19. The toy glove described in claim 18, further comprising:

(d) a body harness for carrying and holstering said canister.

20. The toy glove described in claim 18, wherein said canister is strapped to the wrist of the glove wearer and the length of said flexible tubing is limited to the distance between the wrist and the palm of an average user.

* * * * *